United States Patent [19]

Reese

[11] 4,244,533

[45] Jan. 13, 1981

[54] METHOD OF OPERATING AN AIR SENSOR

[75] Inventor: Walter J. Reese, North Huntington, Pa.

[73] Assignee: PPG Industries, Inc., Pittsburgh, Pa.

[21] Appl. No.: 72,804

[22] Filed: Sep. 5, 1979

[51] Int. Cl.[3] ..... B65H 54/00

[52] U.S. Cl. ..... 242/18 R; 242/18 G; 242/36; 242/43 R

[58] Field of Search ..... 242/36, 39, 18 R, 18 DD, 242/18 G, 43 R, 57, 49

[56] References Cited

U.S. PATENT DOCUMENTS

| | | | |
|---|---|---|---|
| 3,845,912 | 11/1974 | Eichmanns et al. | 242/18 R |
| 4,169,565 | 10/1979 | Blok et al. | 242/18 R |

*Primary Examiner*—Stanley N. Gilreath
*Attorney, Agent, or Firm*—John E. Curley

[57] ABSTRACT

A system is described for venting the gas line of an air sensing device used to determine package build on a winding device for winding strand to prevent inaccurate readings of the air sensor caused by moisture. The venting system is operated through a solenoid switch to send air through the main air sensing channel in the reverse direction when the winder is stopped for package replacement.

3 Claims, 3 Drawing Figures

METHOD OF OPERATING AN AIR SENSOR

BACKGROUND OF THE INVENTION

Air sensors have been utilized in the past to determine package build in the winding of various strand-type materials. Thus, in U.S. Pat. No. 3,845,912 an air sensor is shown which is utilized to sense the diameter of a forming package as it is being wound on a winder. As the package winds on the winder, air is introduced onto the surface of the package and flows backward into the sensor and a diaphragm associated with the air sensing device. The air returning to the device is amplified by the diaphragm and in response to the amplification of the pressure measurement, a pneumatic relay switch activates suitable mechanical equipment to move the package away from the air sensor as the package builds on the surface of the winder.

While the air sensing device shown in the aforementioned U.S. Patent serves a useful purpose in providing a necessary tool for sensing package build it is subject to certain restrictions. Thus it has been found that sensing devices of the type shown in the aforementioned patent are subject to imprecise functioning if the strand material being wound on the package is wet. Frequently water is trapped in the central passageway of such air sensing devices when the winder is stopped which causes improper signals when the winder is restarted thus causing the package being built on the mandrel to, in some instances, be improperly measured. In some instances improper measurement of the package diameter can result in damage to the package caused by the package striking the corner or front of the air sensing device itself.

Thus, in accordance with the instant invention a method and apparatus is provided which substantially eliminates the problems associated with water entrapment in the sensor. The method and apparatus provided by the instant invention substantially eliminates the problems associated with the prior art device in winding wet packages while utilizing air sensing devices similar to those shown in the prior art. Thus it is now possible in accordance with the instant invention to accurately measure package diameter as it is being built during a forming operation and to move the package as the diameter does build without damaging or in any way interfering with the winding of the strand material utilizing an air sensing device. The novel system permits the operation of air sensors to determine package build and to move packages away from traversing mechanisms as the package builds in accordance with such measurements while still providing adequate safeguards to insure against the improper reading of air pressures during the operation of an air sensor.

THE PRESENT INVENTION

The present invention involves utilization of a three-way solenoid valve in the air lines of an air sensing device which manually or automatically, upon cessation of the winding of the strand material, causes a purging of the central portion of the air sensing device to eliminate any residual moisture accumulated in the central portion of the device thereby rendering it suitable for use in rewinding further packages.

In the practice of the instant invention air is purged through an air jet onto the surface of the winder on which a package is being built. The air is bounced or reflected from the surface on which it is impinged and the jet is provided with a return air line which is used in conjunction with a diaphragm amplifier in communication with the return line to sense the air pressure in the return line. This pressure is amplified and in turn produces a signal which is transmitted to the winder. Mechanical response to the sensed pressure moves the winder away from the surface of the air jet as the package builds. When the desired package size is reached the package is removed from the winder and the winder is returned to its normal operating start-up position. A switch is then activated to disengage the return line from the diaphragm and introduce a purge stream of air through the central passageway to effectually remove all moisture thereupon. A new winding tube is then placed on the winder, and the winder is started by a switch which disengages the purge stream from the central passageway and connects it to the diaphragm so that it once again can sense air pressure as the package is wound.

BRIEF DESCRIPTION OF THE DRAWINGS

The invention will now be described with reference to the accompanying drawings in which.

DETAILED DESCRIPTION OF THE DRAWINGS

Figure 1:
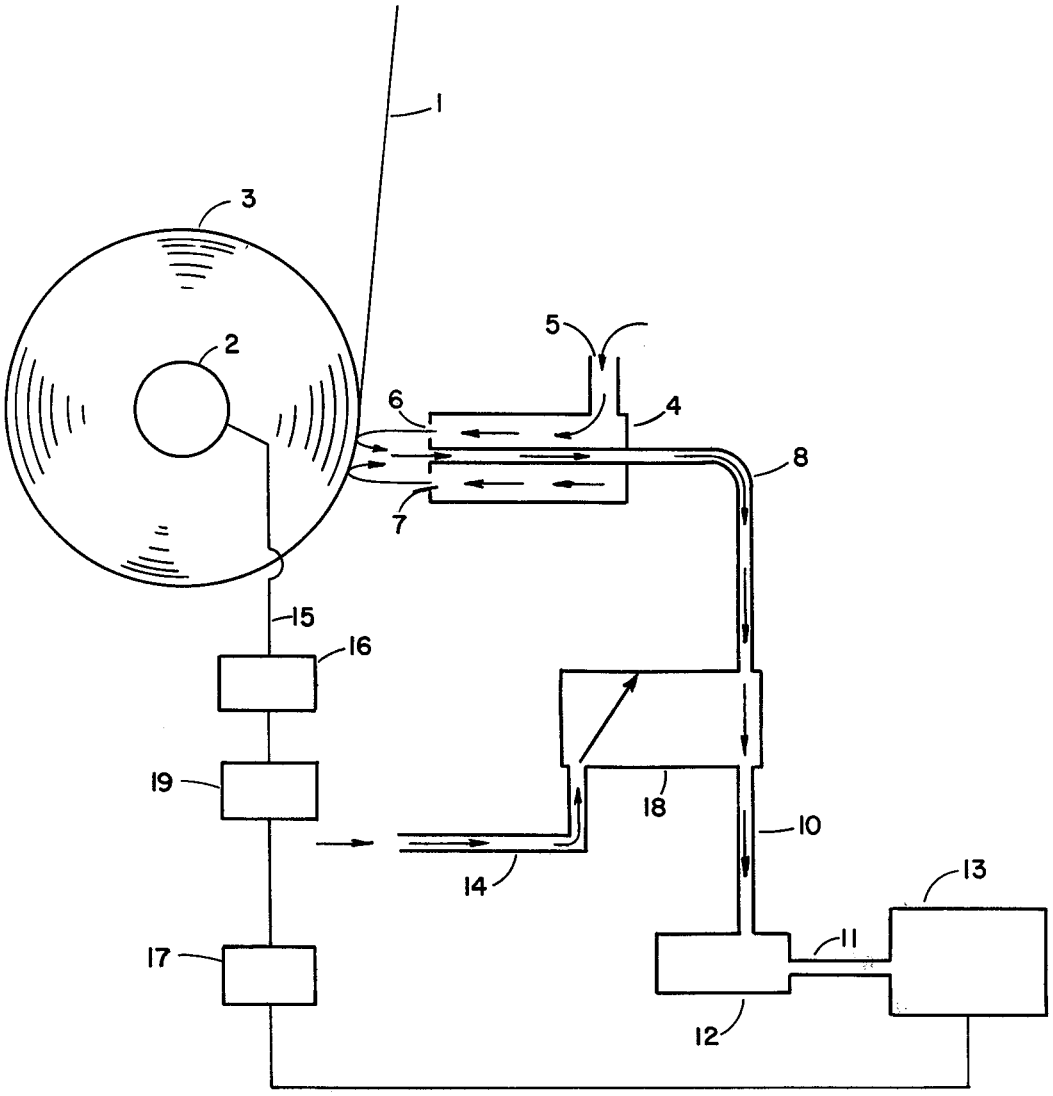
FIG. 1 is a diagrammatic illustration of a winding operation utilizing an air sensor to maintain a uniform distance between a forming package and a sensing device during package build.

As shown in FIG. 1 a winder 2 is shown with a strand 1 being wound to form a package 3 thereon. Positioned laterally from the surface of the package 3 is an air sensor 4. The air sensor 4 comprises a cylindrical chamber 7. The air sensor 4 has an air conduit 5 which introduces air into a chamber 7. The air is passed from the chamber 7 through slot 6 which is circumferentially disposed around the chamber 7. The air is bounced off or reflected from the surface of the package 3 and enters a central conduit 8 provided through the center of the air sensor 4 and is passed through a solenoid valve 18 to a conduit 10 where it enters an air amplifier 12. The air amplifier 12 is in communication through conduit 11 with a pneumatic switch control system or relay 13. The switch 13 is designed to produce a signal in response to the pressure measured by the amplifier 12 and transmitted to the switch 13. A signal corresponding to the pressure read by the switch 13 is passed to a timer 17 which actuates an arm drive motor 19 to move the package 3 away from the air sensor 4 in timed response. A second air conduit 14 is shown connected to the solenoid valve 18 which wil be described in reference to FIGS. 2 and 3. Also connected to the winder 2 is a mechanical connection 15 which is connected to the arm drive clutch 16.

Figure 2:
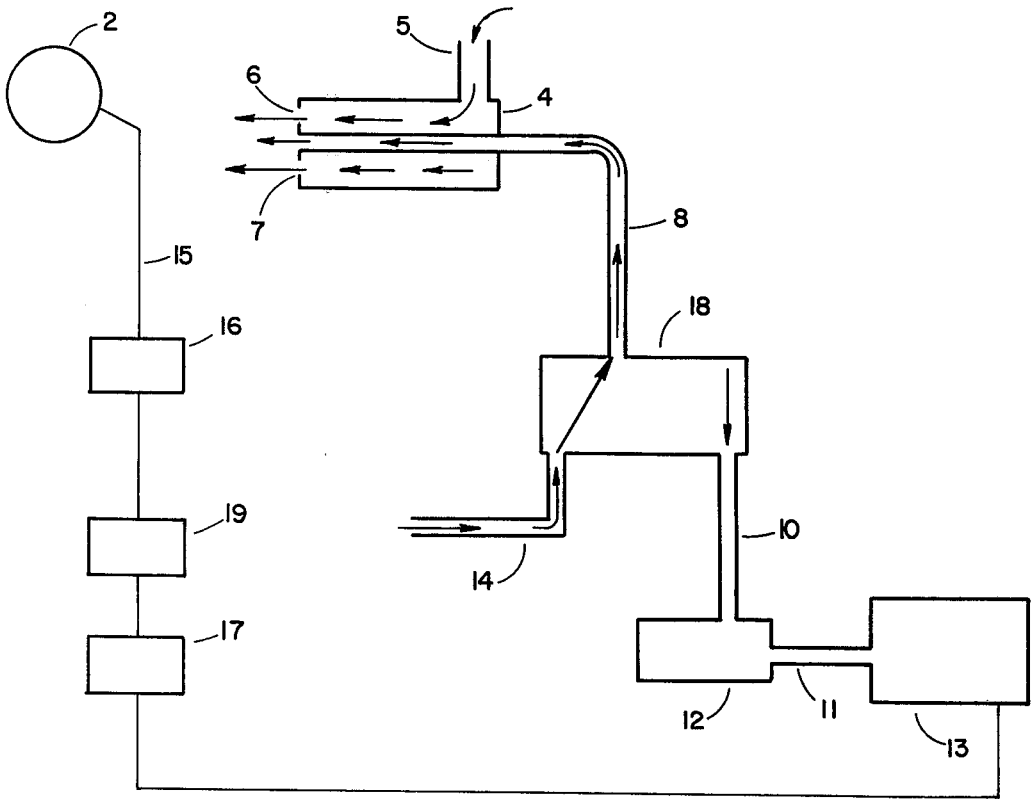
FIG. 2 is a diagrammatic illustration of FIG. 1 showing the solenoid in a second position prior to the winding operation.
Figure 3:
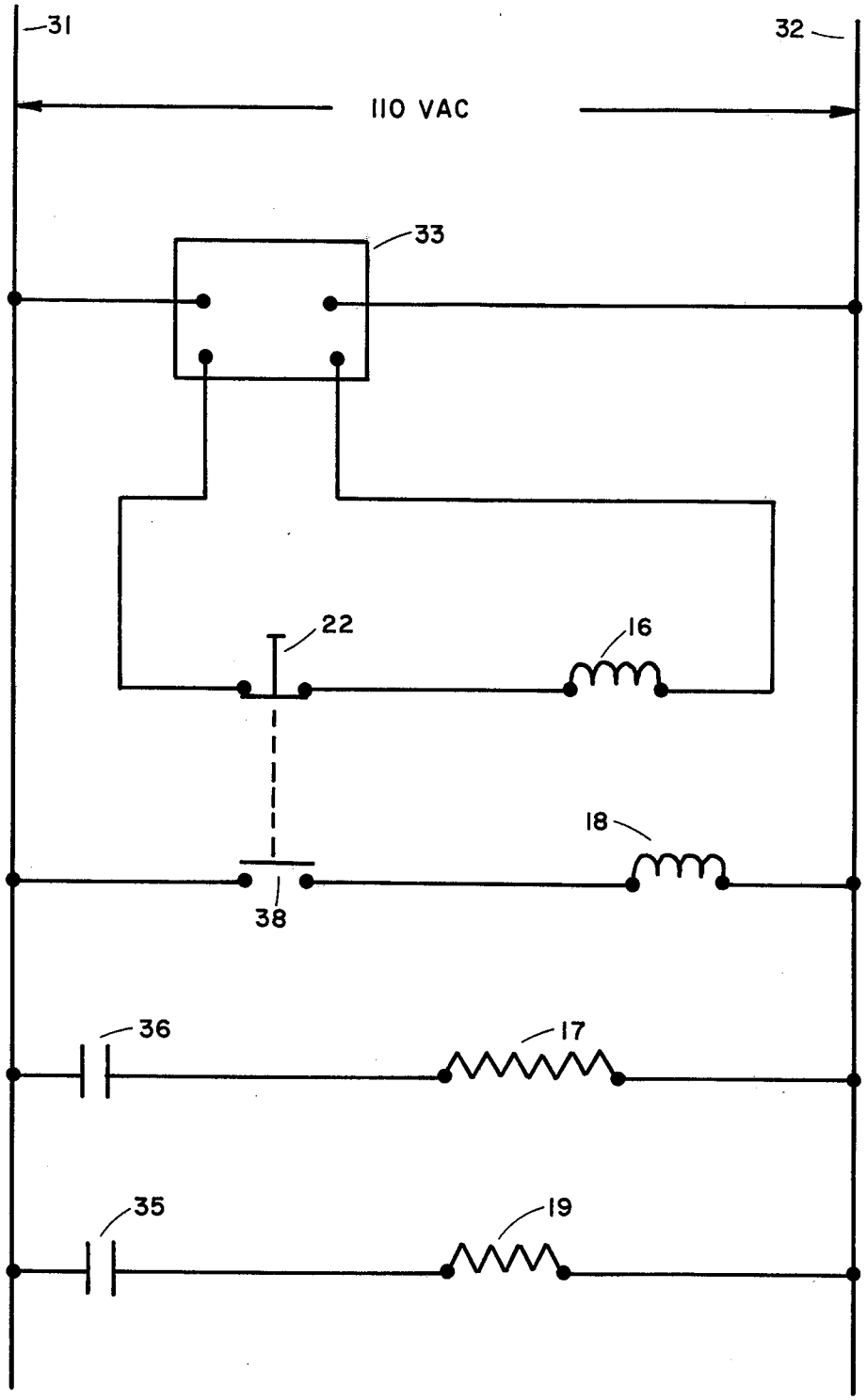
FIG. 3 is an electrical schematic diagram of the air purge system of the invention.

Turning to FIG. 2, the solenoid valve 18 is shown in a second position. As shown in that drawing, the winder 2 is stopped and the package has been removed from it. When a new tube is placed on the winder and it is moved to its winder start-up position, a push button contact 22 shown in FIG. 3 is manually activated. This disengages clutch 16 permitting the winder 2 to be moved to a start-up winding position and also produces a signal to the solenoid valve 18 which moves it laterally and connects conduit 14 with conduit 8. Thus the communication between conduit 8 and the air amplifier 12 is cut off by movement of the solenoid valve 18. Thus when the winder 2 is stopped, the package 3 is doffed, and the push button is activated to transmit the electrical signal to move the solenoid valve 18, and air is introduced via conduit 14 into conduit 8 in a reverse direction so that the air being introduced into the air sensor 4 and the air introduced into the conduit 8 are travelling in the same direction. In this manner, the air traveling in conduit 8 purges the line 8 of any water or dust or any other contaminates contained therein. As soon as the push button is released by the operator the clutch 16 is engaged and the winder 2 is actuated to begin winding a new package. This release of the push button disengages the air purge by moving the solenoid valve 18 to disengage air in conduit 14 from the conduit 8 and communication is again established between conduits 8 and 10. The system is now again in the position shown in FIG. 1 and air is again transmitted from the surface of the package as it is being built on the winder 2 to the air amplifier 12 through conduit 11 to pneumatic relay 13 to continuously move winder 2 away from the air sensing device 4 as the package 3 builds on the winder 2.

FIG. 3 is an electrical schematic view of the air purge system of the invention and shows an AC power supply 31 and 32 which feeds a DC power supply 33 connecting to the winder arm drive motor 19 through an electromagnetic clutch 16. Power is used to drive the motor 19 which moves the winder 2 away from the sensor 4 in response to the closing of contacts 36 which when actuated by the pneumatic relay 13 then actuate timer coil 17 thus shifting timer contacts 35 and applying power to the arm drive motor coil 19 in timed intervals. The motor runs for the timed interval and is repeatedly actuated until the package build reaches the extent of the timed run at which time contacts 35 and 36 remain open and the winder 2 stops. Activation of the push button 22 closes the circuit 38 of the air purge solenoid valve 18 to purge the sensor 4 and the unit is then ready to resume a normal operation.

Thus as can be readily seen by virtue of the instant invention means are provided to automatically purge line 8 when the winder 2 is stopped. This is the important aspect of the instant invention since experience has shown that frequently various contaminates enter the tube 8 during doffing of a package 3. If dust or water droplets appear in the conduit 8 while the winder is being stopped, when the winding operation is resumed, incorrect measurements of the back pressure of the air being deflected off the package is recorded by the amplifier 12 and the winder is frequently found not to move sufficiently from the surface of the sensor 4 during winding resulting in package damage. By virtue of the instant invention when the winder is stopped the conduit 8 is automatically purged by movement of the solenoid valve through the push button and the introduction of air through the conduit 14 to the conduit 8 so that the channel 8 is cleared completely before rewinding is resumed. In this fashion a constant and accurate measurement of the air pressures measured by deflecting air from the surface can be made and movement of the air sensor can occur automatically without any danger of damage to the package.

While the invention has been described with reference to certain specific examples and illustrated embodiments it is not intended to be limited thereby except insofar as appears in the accompanying claims.

I claim:

1. In an apparatus for sensing the surface of material being collected on a winder by introducing air onto the said surface material thereof and means are provided to sense the back pressure of air reflected from said surface using an amplifier and a pnswitch to actuate movement of the winder to maintain a set distance between the winder surface and the air introducing means, the improvement comprising:

valve means in communication with the back pressure sensing means, push button means associated with the winder to produce a signal when the winder is stopped and the push button is actuated, to thereby move said valve means and provide a connection through said valve means to a secondary air supply to disconnect said back pressure sensing means and means to introduce said secondary air supply in a direction countercurrent to the flow of air utilized to sense said back pressure to thereby purge the air sensing means of any accumulation of contaminates contained therein before starting said winder.

2. The apparatus of claim 1 including means to reconnect said air sensing means when the winder is started by signaling the valve means and moving it in a direction to connect it with the air amplifier means.

3. A method of sensing the surface of material being collected on a package being wound on a cylindrical winder comprising:

positioning an air sensing means close to the surface of material being collected on said winder, winding a strand on said rotating surface, introducing a first air supply onto the surface of said material being wound on said winder, reflecting air from the surface of said material through the center of the air sensing means through a valve means and to an amplifier means, producing a signal in response to the air amplification of the back pressure to move the winder away from the surface of the air sensing means as the depth of the package being wound thereon increases, producing a signal to a second air introduction means to introduce a secondary source of air to said valve means and disconnecting said first air supply when the winder is in a rest state passing said secondary air countercurrent to the flow of the air being passed to the air amplifier means to thereby purge the air sensing means of any contaminates contained in the air sensing passage and moving the valve to reconnect said first air supply to the sensing means when the winder is actuated again.

* * * * *

UNITED STATES PATENT AND TRADEMARK OFFICE

CERTIFICATE OF CORRECTION

PATENT NO. : 4,244,533

DATED : January 13, 1981

INVENTOR(S) : Walter J. Reese

It is certified that error appears in the above-identified patent and that said Letters Patent are hereby corrected as shown below:

Claim I, Column 4, line 15 "pnswitch" should be --pneumatic--

Signed and Sealed this

*Nineteenth* Day of *May 1981*

[SEAL]

*Attest:*

RENE D. TEGTMEYER

*Attesting Officer*

*Acting Commissioner of Patents and Trademarks*